US005624249A

United States Patent [19]

Rohlfing

[11] Patent Number: 5,624,249

[45] Date of Patent: Apr. 29, 1997

[54] PUMPING PROCESS FOR OPERATING A MULTI-PHASE SCREW PUMP AND PUMP

[75] Inventor: Gerhard Rohlfing, Hille, Germany

[73] Assignee: Joh. Heinrich Bornemann GmbH & Co. KG, Obernkirchen, Germany

[21] Appl. No.: 530,345

[22] PCT Filed: Apr. 28, 1994

[86] PCT No.: PCT/DE94/00477

§ 371 Date: Oct. 6, 1995

§ 102(e) Date: Oct. 6, 1995

[87] PCT Pub. No.: WO94/27049

PCT Pub. Date: Nov. 24, 1994

[30] Foreign Application Priority Data

May 19, 1993 [DE] Germany ..... 43 16 735.7

[51] Int. Cl.[6] ..... F01C 2/04; F01C 1/16

[52] U.S. Cl. ..... 418/102; 418/202

[58] Field of Search ..... 418/201.1, 202, 418/15, 102

[56] References Cited

U.S. PATENT DOCUMENTS

| | | | |
|---|---|---|---|
| 4,684,335 | 8/1987 | Goodridge | 418/202 |
| 4,995,797 | 2/1991 | Tsuboi | 418/201.1 |
| 5,348,453 | 9/1994 | Baran et al. | 418/202 |

FOREIGN PATENT DOCUMENTS

| | | | |
|---|---|---|---|
| 183380 | 6/1986 | European Pat. Off. . | |
| 290241A5 | 5/1991 | Germany . | |
| 481084 | 3/1938 | United Kingdom | 418/202 |
| 2227057 | 7/1990 | United Kingdom . | |

OTHER PUBLICATIONS

"Screw Spindle Pumps for the Delivery of Multi-phase Mixtures", Pump Vacuum Compressors 1988 pp. 14–20.

*Primary Examiner*—Charles G. Freay
*Attorney, Agent, or Firm*—Whitham, Curtis, Whitham & Curtis

[57] ABSTRACT

The invention relates to a pumping process for operating a multi-phase screw pump with at least one feed screw surrounded by a housing having at least one inlet on one side and at least one outlet at its top, in which the intake medium is conveyed parallel to the screw shaft in a continuous low-pulsed stream and continuously discharged at the outlet. This invention also relates to a multi-phase screw pump. In order to prevent the drawbacks usually occurring in dry running phases, the invention proposes that a partial liquid volume flow (liquid circulation) be separated on the pressure side and returned in metered quantities into the intake regions and thus kept in circulation.

15 Claims, 2 Drawing Sheets

PUMPING PROCESS FOR OPERATING A MULTI-PHASE SCREW PUMP AND PUMP

The invention relates to a pumping process for operating a multi-phase screw pump with at least one feed screw surrounded by a housing, having at least one inlet and at least one outlet, with the intake medium being conveyed parallel to the screw shaft in a continuous low-pulsed stream and continuously discharged at the outlet.

The invention also relates to a multi-phase screw pump with at least one feed screw, surrounded by a housing, which has at least one inlet and at least one outlet, with the inlet communicating with a suction chamber located upstream from the feed screw and the outlet being connected with a pressure chamber located downstream from the feed screw.

The term "multi-phase" refers to a mixture of gas and liquid. In multi-phase transport, especially with high gas rates or dry running, the liquid is usually completely expelled. The feed elements then turn without a liquid to seal the gaps; the pump can no longer deliver the maximum pressure, which results in an interruption of feed. The heat of compression resulting from the compression of the gas phase can no longer be removed sufficiently. This results in overheating of the feed elements and their expansion with heat, which can result in destruction of the pump through contact with the housing.

In addition, with high gas rates or dry running, insufficient lubrication develops at the shaft seals, which can result in overheating at the shaft seals and hence to their destruction. When the residual liquid level on the inlet side is at the lower edge of the feed screws, the shaft seals are dry; the lubricant formed by the intake medium evaporates; the heat of friction is no longer removed which results in the destruction of the shaft seal. This problem is currently solved by permanent lubrication and cooling using an external seal oil assembly. These assemblies however are cost-intensive and prone to failure and therefore adversely affect the economy of such pumps.

The goal of the invention is to improve the pumping method described at the outset as well as the multi-phase screw shaft pump described at the outset in such fashion that neither extremely high gas content nor prolonged phases of dry running result in interruption of feed or in damage.

This goal is achieved according to the invention with respect to the pumping method by virtue of the fact that on the pressure side a partial liquid volume flow (liquid bypass) is separated and fed back into the intake area with metering, and is thus kept in circulation.

With regard to the pump, the stated goal is achieved according to the invention by virtue of the fact that a liquid bypass line is connected to a lower portion of the pressure chamber and communicates with the suction chamber.

According to the essential idea of the invention, therefore, assurance must be provided that sufficient liquid remains in the pump for safely performing its functions even at high gas rates or limited dry running, and is not expelled. This liquid remaining in the pump housing is intended to wet the shaft seals permanently and sufficiently, possibly in mist form.

The degree of separation required to achieve the stated goal and the volume of liquid to be kept in circulation can be determined on the basis of the housing and flow configurations. The metering of the liquid circulation can take place as a function of the pump differential pressure. However, it is also possible to connect a metering pump or a temperature-controlled valve in the liquid bypass line. It is advantageous in this regard if about 3% of the normal delivery flow is kept in circulation.

In order to facilitate separation of the liquid phase from the gas phase of the delivered medium in the pressure chamber, it is advantageous for the flowrate of the medium emerging from the feed screw on the discharge side to be reduced. This can be accomplished in the device by virtue of the fact that the pressure chamber has a cross section that increases as viewed in the direction of the through flow of the medium. In addition, flow guide means can be provided in the pressure chamber that reinforce separation and/or guide the liquid phase of the medium emerging from the feed screw against the associated shaft seal and then the contact area of the liquid bypass line.

Further features of the invention will be evident in the subclaims and will be described in greater detail in conjunction with an embodiment.

In the drawing, two embodiments of the invention are shown as examples.

Figure 1:
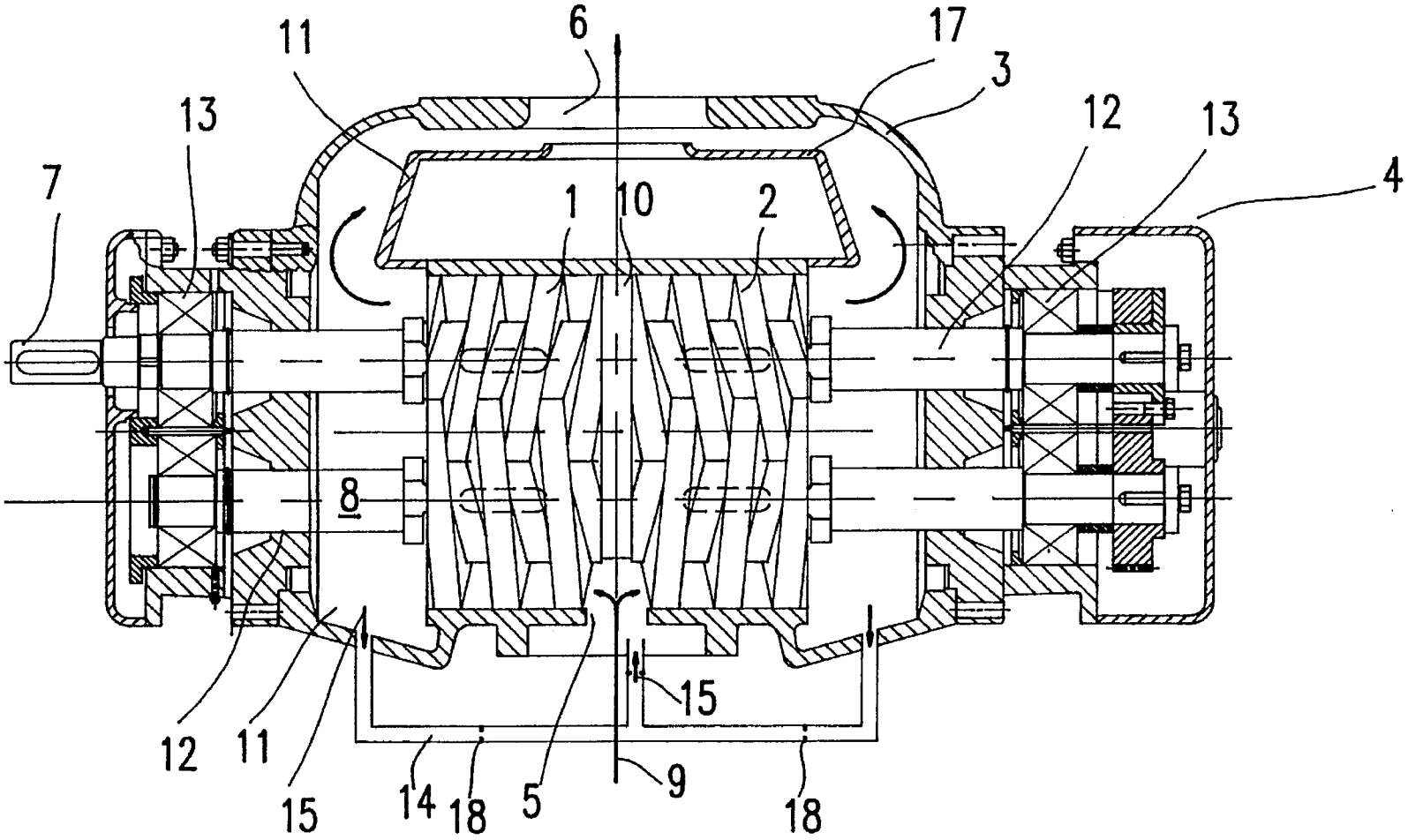
FIG. 1 shows a screw pump in a lengthwise section.

The screw pump shown in FIG. 1 has two pairs of feed screws as delivery elements, said screws meshing with one another without contact and turning in opposite directions, said screws each comprising a right-hand feed screw 1 and a left-hand feed screw 2. This two-stream arrangement compensates for axial thrust. The meshing feed screws, together with housing 3 surrounding them, form individually enclosed feed chambers. When turned by a drive shaft 7, these chambers move continuously and parallel to shafts 7, 8 from the intake to the discharge side. The rotational direction of drive shaft 7 determines the feed direction of the feed chambers (see arrows in FIG. 1).

The torque transfer from the drive shaft to the driven shafts takes place through a gear transmission 4 located outside pump housing 3, the setting of said transmission ensuring zero-contact operation of the feed elements.

Pump housing 3 has an inlet 5 and a outlet 6. The latter can preferably be provided on the top of pump housing 3. In this case, the drawing shows a perpendicular central section through the screw pump. However, the drawing can also be a horizontal section in which intake and discharge stubs 5 and 6 are opposite one another laterally, while the two shafts 7 and 8 are arranged side-by-side in a common horizontal plane.

Medium 9 that flows into the pump through intake stub 5 is fed in pump housing 3 in two partial streams to the respective central suction chambers 10 located upstream from the associated feed screws 1 or 2. A pressure chamber 11 is located downstream from each of these feed screws 1, 2, said chamber being sealed axially from the exterior by shaft seals 12, which serve to seal outer bearing 13. Pressure chamber 11 has a cross section that increases as viewed in the direction of flow of medium 9.

If we assume that the drawing shows a vertical lengthwise central section, a liquid bypass line 14 is connected at the lowest point in pressure chamber 11, said line communicating with suction chamber 10. The partial flow volume that is separated on the pressure side from the delivered liquid-gas mixture and is fed back into the intake area with metering, is marked by arrow 15 and is returned as a liquid circulation from suction chamber 10 into pressure chamber 11.

It is clear from the drawing that the liquid phase of medium 9 emerging from feed screw 1, 2 is guided against the associated shaft seal 12 and then reaches the connecting area of liquid bypass line 14 by gravity. The increase in the flow cross section of pressure chamber 11 causes the flowrate of the emerging medium to decrease, so that separation of the liquid phase from the delivered mixture is promoted. The feed of the liquid phase into the connecting area of liquid bypass line 14 can be favored by flow guide means 17 shown only schematically in the drawing, said means also being able to serve to support separation as well as regulation of the liquid level in pressure chamber 11.

The connection of liquid bypass line 14 to pressure chamber 11 should be located sufficiently low that a permanent liquid circulation (avoiding the entry of gas) is ensured. This degree of separation can be determined on the basis of the housing and flow configuration. It has proven advantageous in this regard to keep approximately 3% of the normal delivery flow in the liquid circulation. The liquid level thus ensured in pump housing 3 or in pressure chamber 11 can as a rule be below shafts 7 and 8. Wetting of shaft seals 12 as a consequence of this direct flow is sufficient as a rule for adequate lubrication of shaft seals 12. Permanent irrigation of shaft seals 12 is required only with particularly sensitive sealing materials. In this case, a horizontal arrangement of the two shafts 7 and 8 next to one another and a correspondingly higher liquid level in pressure chamber 11 is recommended.

Provision of the delivery elements with sufficient gap-sealing liquid is also ensured, thanks to liquid bypass line 14 according to the invention, when the two shafts 7 and 8 are located one above the other in a vertical plane. The liquid adhering to the tooth crest of the lower feed screw is flung into the tooth gullet of the upper feed screw and then migrates toward the tooth crest along the flanks of the tooth, under centrifugal force. The mesh and tooth crest remain permanently wetted as a result. This minimum wetting of the dead-volume space suffices to maintain delivery.

A suitably dimensioned orifice 18 can be connected in liquid bypass line 14 to meter the liquid circulation.

Since the liquid circulation provided according to the invention is advantageous only when the liquid phase of the medium to be conveyed is not sufficient, this liquid circulation can be connected as needed, for example by a temperature control.

Figure 3:
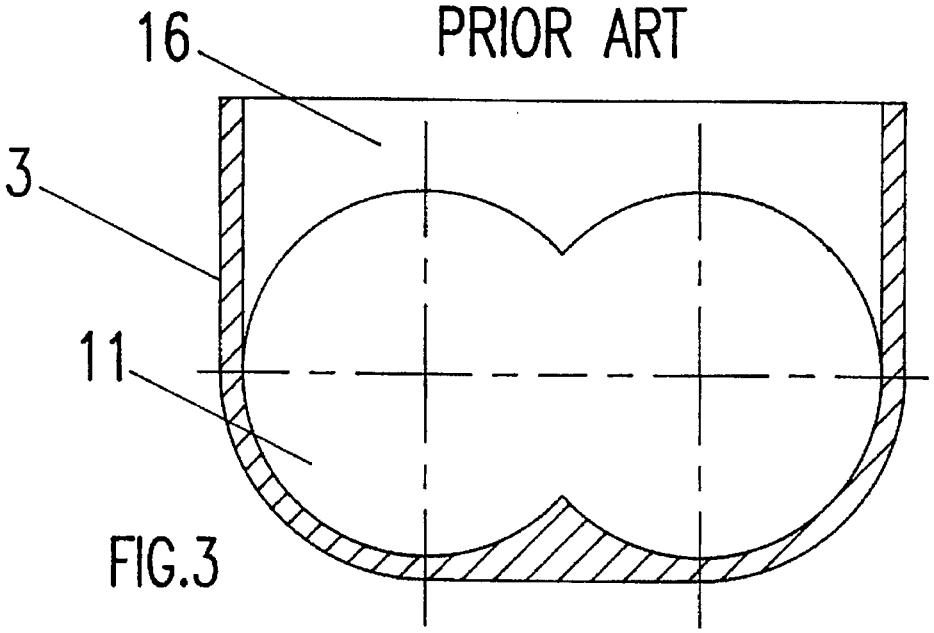
FIG. 3 is the same as FIG. 2 but shows a cross section through a known pump housing (prior art).

FIG. 3 is a schematic diagram of a cross section through a conventional pump housing, likewise intended to incorporate two feed screw pairs turning in opposite directions in accordance with FIG. 1. In this case, liquid delivery takes place, as viewed axially, in each case from the exterior to the middle of the pump into a pressure chamber 11 which in each case is connected directly downstream from the feed screws, said chamber making a transition to a pressure slot 16 located approximately centrally in the pump housing. The flowrate in pressure chamber 11 and pressure slot 16 at the center of the pump is approximately 3 to 8 m/s in such embodiments. For gas delivery, the residual liquid in pressure chamber 11 is soon expelled by entrainment in the gas and evaporation by the heat of compression and friction.

Figure 2:
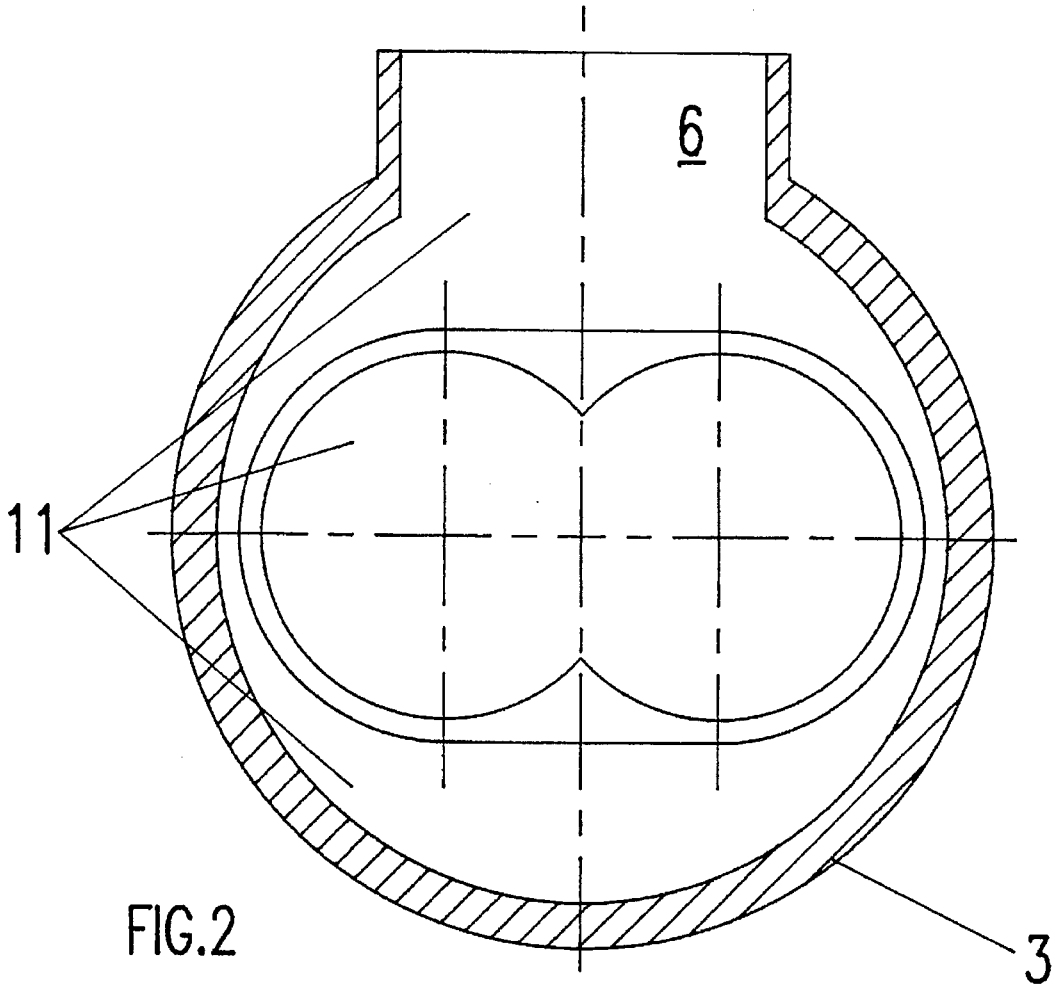
FIG.2 PRIOR ART
FIG. 2 is a schematic diagram of a cross section through a pump housing of a modified design.

On the other hand, the design according to the invention shown in FIG. 2 shows that pressure chamber 11 in pump housing 3 also extends below the feed screw pair as well as the delivery chambers formed by them, together with the housing surrounding them. Pressure chamber 11 is designed so that the flowrate of the delivery current emerging on the pressure side from the feed screw tends toward zero in its lower part. As a result, the liquid and gas phases are separated because of the density differential.

The configuration shown in FIG. 2 is possible with a central or a lateral pressure chamber.

I claim:

1. A pumping method for operating a multi-phase screw pump with at least one feed screw surrounded by a housing that contains at least one inlet, and at least one outlet, said feed screw having a pressure side, said method comprising steps of:

drawing a medium into said inlet in a continuous low-pulsed feed stream in a direction parallel to a screw shaft of said feed screw;

expelling said medium continuously at the outlet;

separating a liquid phase of said medium from a gas phase of said medium, wherein the medium flow emerging from the pressure side of said feed screw has its flow direction diverted;

removing a partial liquid volume flow from the liquid phase;

recycling and metering said partial liquid volume flow into the inlet; and recombining a surplus liquid volume flow of said partial liquid volume flow with the gas phase in the outlet, wherein approximately 3% of a normal delivery flow is kept in said partial liquid volume flow.

2. A pumping method according to claim 1, wherein the metering of the partial liquid volume flow takes place as a function of a differential pressure of the pump.

3. A pumping method according to claim 1, wherein a flow rate of a medium flow emerging from the pressure side of said feed screw is reduced.

4. A pumping method according to claim 1, wherein said multi-phase screw pump further includes at least two feed screws of said at least one feed screw arranged for double flow and each of said feed screws including outside bearings, a shaft seal and a suction side, the method further comprising the step of:

delivering two partial flows from the suction side of each of said feed screws in opposite delivery directions directed away from one another to the respective pressure side of each of said feed screws and to each respective shaft seal.

5. A multi-phase screw pump comprising:

at least one feed screw surrounded by a housing, said housing having at least one inlet and at least one outlet;

a suction chamber connected to said inlet and being located in a first flow direction relative to said feed screw;

a pressure chamber connected to said outlet and being located in a second flow direction, opposite said first flow direction relative to said feed screws, wherein said pressure chamber includes means for separating a respective liquid phase from the gas phase of a medium flow emerging from said feed screw in said second flow direction into a liquid phase and a gas phase, and a lower section for receiving at least a partial volume of the liquid phase;

a liquid bypass line connected to said lower section, wherein a flowrate in said lower section is approximately zero, said bypass line being connected to said suction chamber and forming, together with said feed screw, a closed bypass for a liquid volume required for permanent sealing of said pump; and flow guide means positioned within said pressure chamber for reinforcing the separation of said liquid phase and said gas phase in pressure chamber.

6. A multi-phase screw pump according to claim 5, wherein said liquid bypass line includes a flow cross section shaped as a function of the differential pressure of the pump.

7. A multi-phase screw pump according to claim 5, further comprising a metering orifice located within said liquid bypass line.

8. A multi-phase screw pump according to claim 5, further comprising a temperature-controlled valve located within said liquid bypass line.

9. A multi-phase screw pump according to claim 5, wherein said housing includes a top positioned opposite said lower section of said pressure chamber and said outlet is located on said top of said housing.

10. A multi-phase screw pump according to claim 5, wherein said liquid bypass line is connected to a lowest point of said pressure chamber.

11. A multi-phase screw pump according to claim 5, further comprising:

two shafts located within said housing connected parallel to one another, said shafts each including two feed screws of said at least one feed screw, said shafts turning in opposite directions and each of said shafts having an outside bearing, wherein said medium flow travels through said inlet to said housing and to said suction chamber in two partial streams, wherein said suction chamber is located centrally within said housing; and a shaft seal connected to each shaft, said pressure chamber being sealed axially by said shaft seal.

12. A multi-phase screw pump according to claim 5, wherein said pressure chamber includes a cross section that increases in said second flow direction.

13. A multi-phase screw pump according to claim 5, further comprising a suitably dimensioned orifice positioned within said liquid bypass line for metering a flow of said liquid volume.

14. A multi-phase screw pump comprising:

at least one feed screw surrounded by a housing, said housing having at least one inlet and at least one outlet;

a suction chamber connected to said inlet and being located in a first flow direction relative to said feed screw;

a pressure chamber connected to said outlet and being located in a second flow direction, opposite said first flow direction, relative to said feed screws, wherein said pressure chamber includes means for separating a respective liquid phase from the gas phase of a medium flow emerging from said feed screw in said second flow direction into a liquid phase and a gas phase, and a lower section for receiving at least a partial volume of the liquid phase;

a liquid bypass line connected to said lower section, wherein a flowrate in said lower section is approximately zero, said bypass line being connected to said suction chamber and forming, together with said feed screw, a closed bypass for a liquid volume required for permanent sealing of said pump;

two shafts located within said housing connected parallel to one another, said shafts each including two feed screws of said at least one feed screw, said shafts turning in opposite directions and each of said shafts having an outside bearing, wherein said medium flow travels through said inlet to said housing and to said suction chamber in two partial streams, wherein said suction chamber is located centrally within said housing;

a shaft seal connected to each shaft, said pressure chamber being sealed axially by said shaft seal; and flow guide means positioned within said pressure chamber, said flow guide means for guiding the liquid phase of said medium flow emerging from said feed screw against the shaft seal and to the liquid bypass line.

15. A multi-phase screw pump comprising:

at least one feed screw surrounded by a housing, said housing having at least one inlet and at least one outlet;

a suction chamber connected to said inlet and being located in a first flow direction relative to said feed screw;

a pressure chamber connected to said outlet and being located in a second flow direction, opposite said first flow direction, relative to said feed screws, wherein said pressure chamber includes means for separating a respective liquid phase from the gas phase of a medium flow emerging from said feed screw in said second flow direction into a liquid phase and a gas phase, and a lower section for receiving at least a partial volume of the liquid phase;

a liquid bypass line connected to said lower section, wherein a flowrate in said lower section is approximately zero, said bypass line being connected to said suction chamber and forming, together with said feed screw, a closed bypass for a liquid volume required for permanent sealing of said pump; and flow guide means positioned within said pressure chamber for regulating a level of said liquid phase in pressure chamber.

* * * * *